US005803214A

United States Patent [19]

Wang

[11] Patent Number: 5,803,214

[45] Date of Patent: Sep. 8, 1998

[54] RETRACTABLE HANDLE MOUNTING ASSEMBLY OF A TRAVEL BAG

[76] Inventor: King-Sheng Wang, No. 569, Ching-Kuo Rd., Ta-Chia Chen, Taichung Hsien, Taiwan

[21] Appl. No.: 891,620

[22] Filed: Jul. 9, 1997

[51] Int. Cl.[6] ..... A45C 13/26

[52] U.S. Cl. ..... 190/115; 190/39; 16/115

[58] Field of Search ..... 190/39, 115; 16/115

[56] References Cited

U.S. PATENT DOCUMENTS 5,499,426 3/1996 Hsieh ..... 16/115
5,689,854 11/1997 Wang ..... 16/115
5,692,266 12/1997 Tsai ..... 16/115
5,694,663 12/1997 Tserng ..... 16/115
5,713,440 2/1998 Chen ..... 190/39 X

*Primary Examiner*—Allan N. Shoap
*Assistant Examiner*—Tri M. Mai
*Attorney, Agent, or Firm*—Bacon & Thomas

[57] ABSTRACT

A retractable handle mounting assembly of a travel bag, including two sleeves connected between a casing and a sleeve holder, two inner tubes joined by a hand grip and moved in and out of the sleeves, two stop members adapted for locking the inner tubes in the received position inside the sleeves, a control knob adapted for releasing the stop members from the inner tubes, two resilient locating devices adapted for locking the inner tubes in the extended position outside the sleeves, and two control rods controlled by a press control device to release the resilient locating devices from the inner tubes.

1 Claim, 8 Drawing Sheets

RETRACTABLE HANDLE MOUNTING ASSEMBLY OF A TRAVEL BAG

BACKGROUND OF THE INVENTION

The present invention relates to a retractable handle mounting assembly for a travel bag, and more particularly to such a retractable handle mounting assembly which can be conveniently operated with one hand.

FIG. 1 shows a travel bag with a retractable handle according to the prior art. This retractable handle comprises two sleeves mounted inside the bag body of the travel bag, two inner tubes joined by a hand grip outside the sleeves and moved in and out of the sleeves, lock means adapted to lock the inner tubes inside the sleeves, and control means mounted in the hand grip and controlled to release the lock means from the inner tubes. This structure of retractable handle is functional, however it still has a drawback. When the lock means is released from the inner tubes, the user shall have to force down the bag body of the travel bag with one hand and then to pull up the hand grip with the other hand, i.e., the retractable handle cannot be conveniently operated with one hand.

SUMMARY OF THE INVENTION

It is the main object of the present invention to provide a retractable handle mounting assembly for a travel bag which can be conveniently operated with one hand. According to the preferred embodiment of the present invention, the retractable handle mounting assembly comprises two sleeves connected between a casing and a sleeve holder, two inner tubes joined by a hand grip and moved in and out of the sleeves, two stop members adapted for locking the inner tubes in the received position inside the sleeves, a control knob adapted for releasing the stop members from the inner tubes, two springy or resilient locating devices adapted for locking the inner tubes in the extended position outside the sleeves, two control rods controlled by a press control device to release the springy locating devices from the inner tubes, and two spring devices respectively mounted on the inner tubes and adapted to push the inner tubes upwardly out of the sleeves when the inner tubes are released from the stop members.

DETAILED DESCRIPTION OF THE PREFERRED EMBODIMENT

Figure 1:
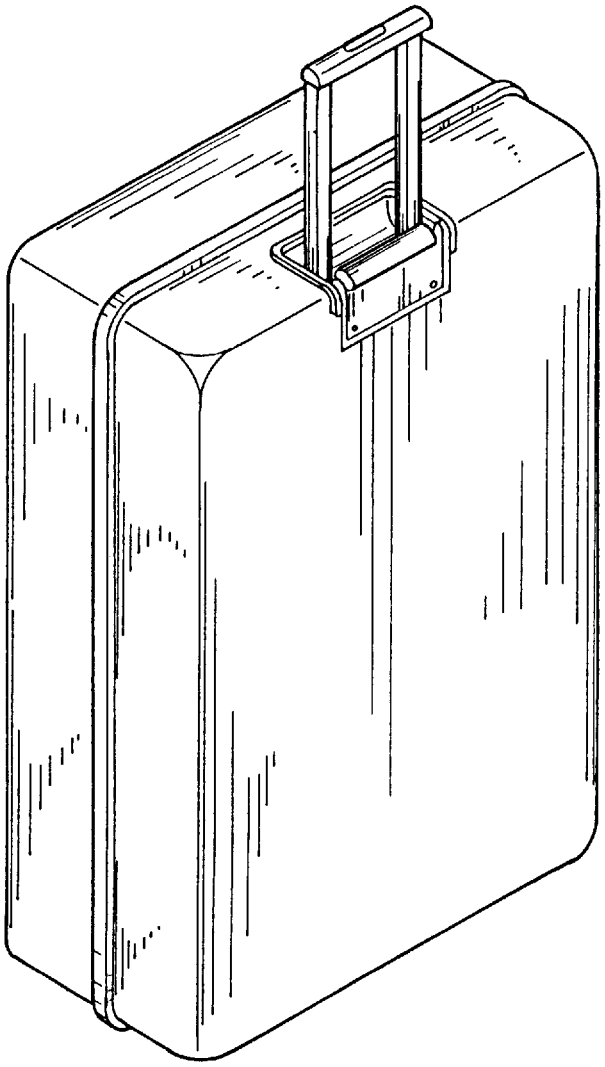
Fig.1 PRIOR ART
FIG. 1 shows a travel bag with a retractable handle according to the prior art.
Figure 2A:
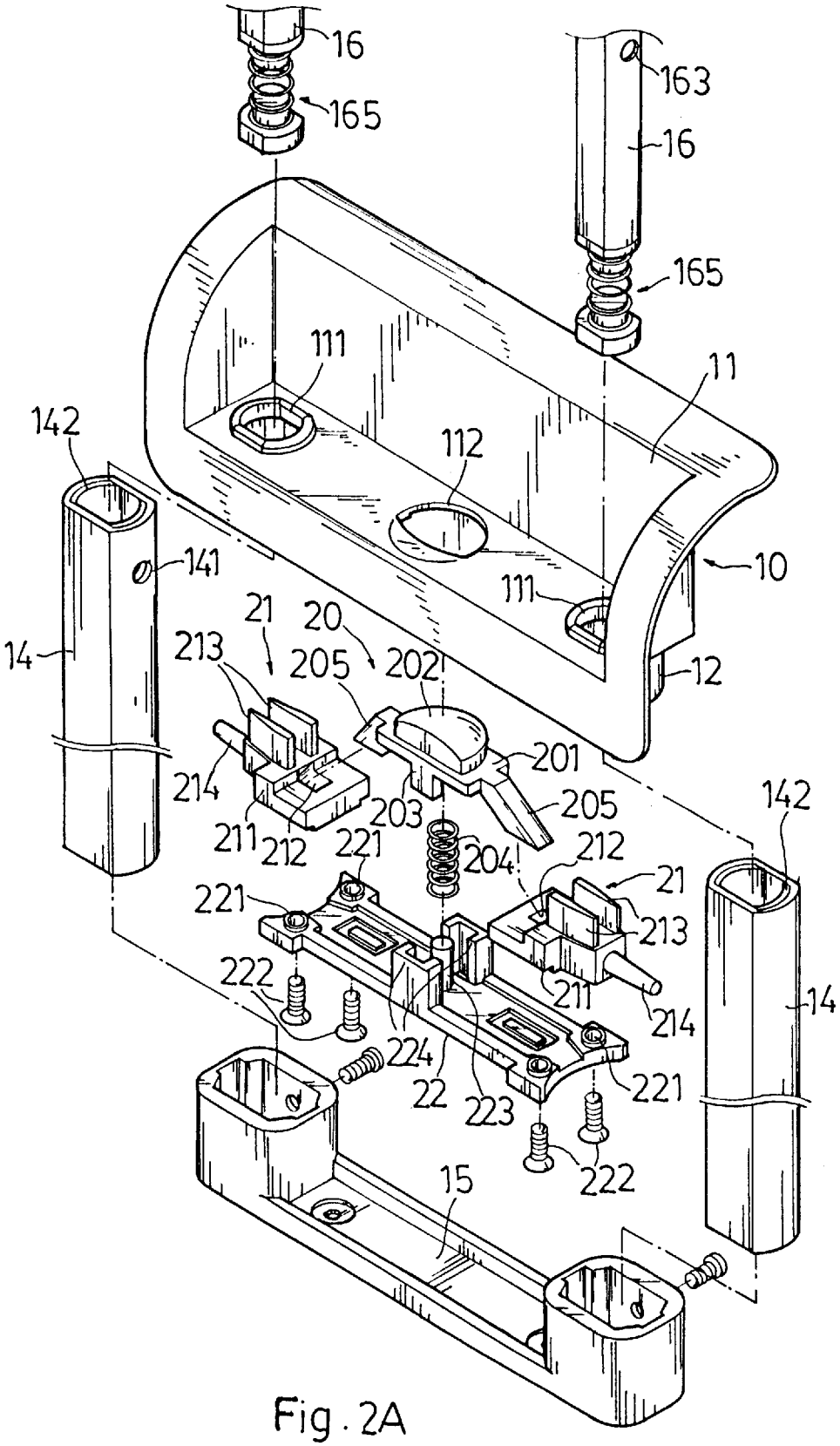
FIG. 2A is an exploded view of a first part of the present invention.
Figure 2B:
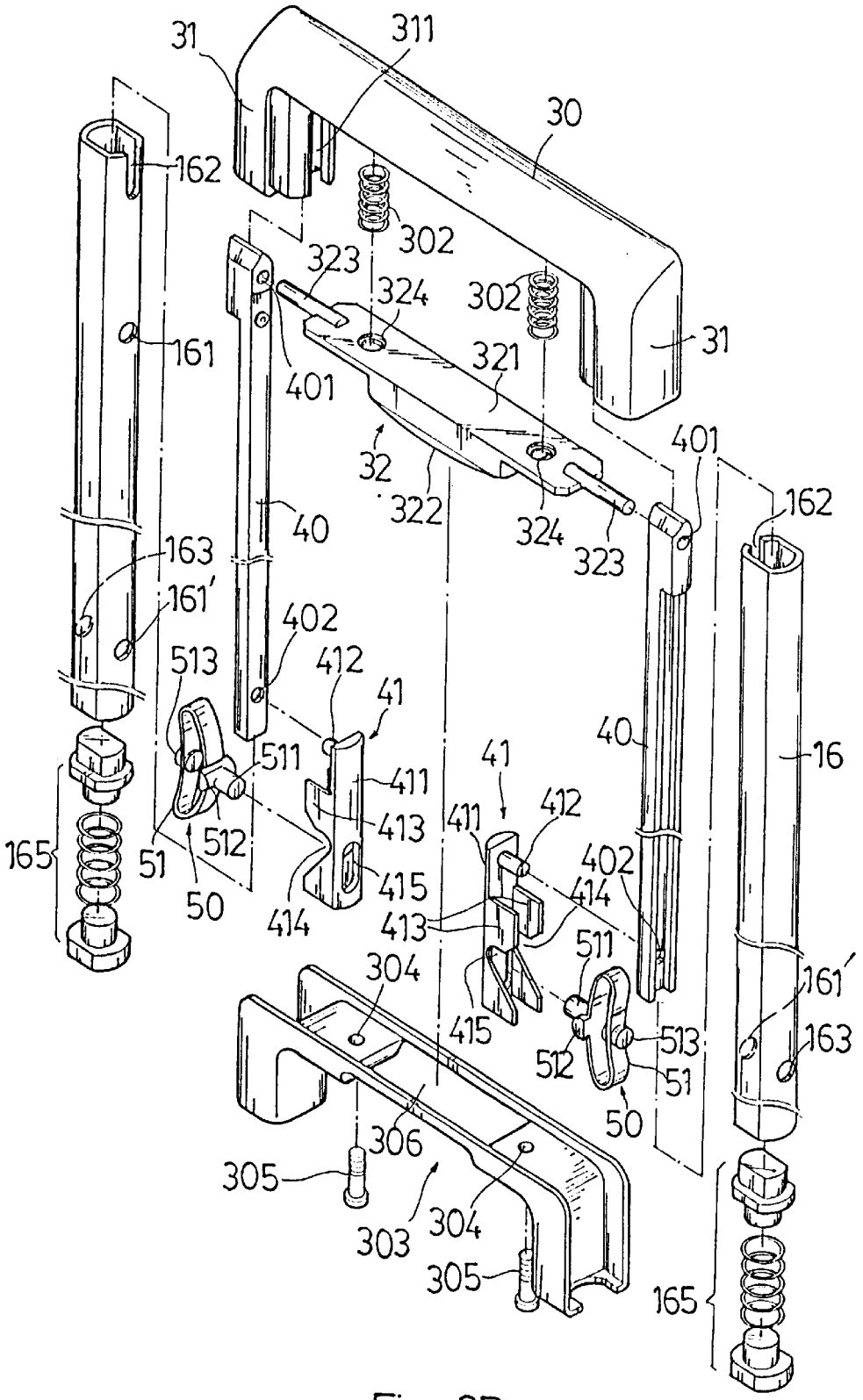
FIG. 2B is an exploded view of a second part of the present invention.
Figure 3:
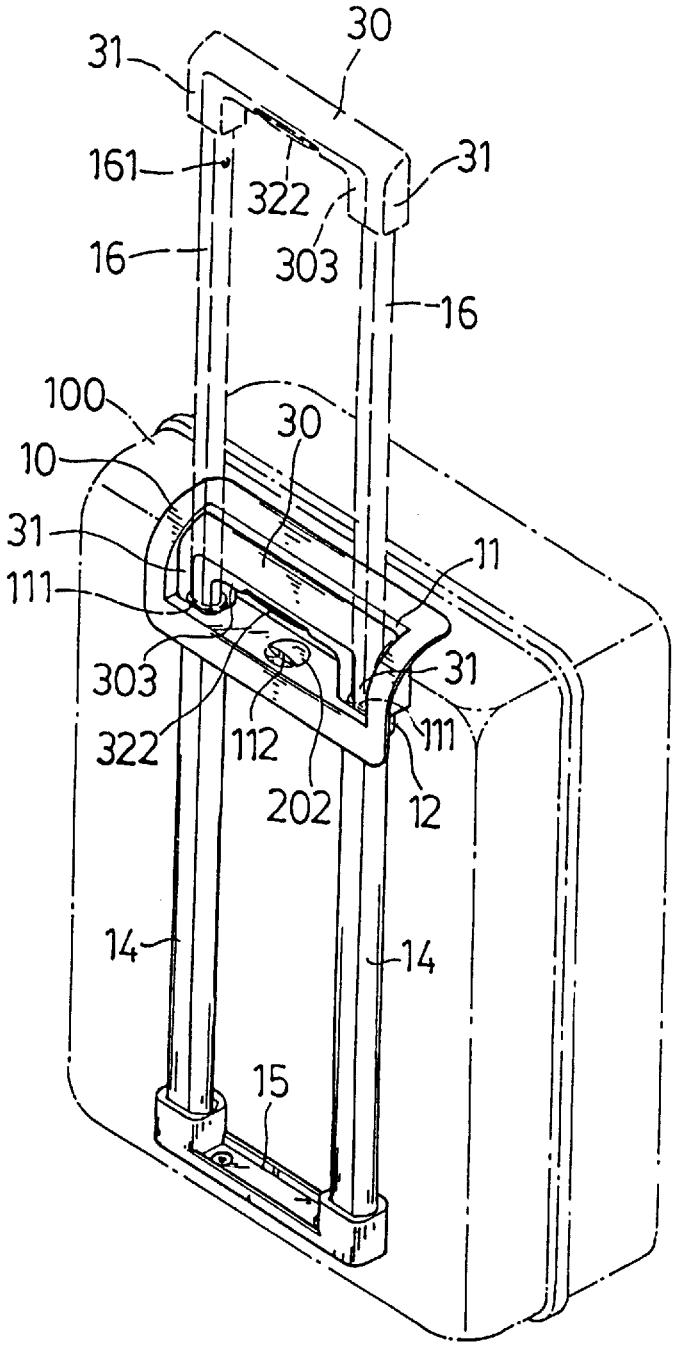
FIG. 3 is a perspective assembly view of the present invention, showing the retractable handle mounting assembly installed, the inner tubes extended out.
Figure 4A:
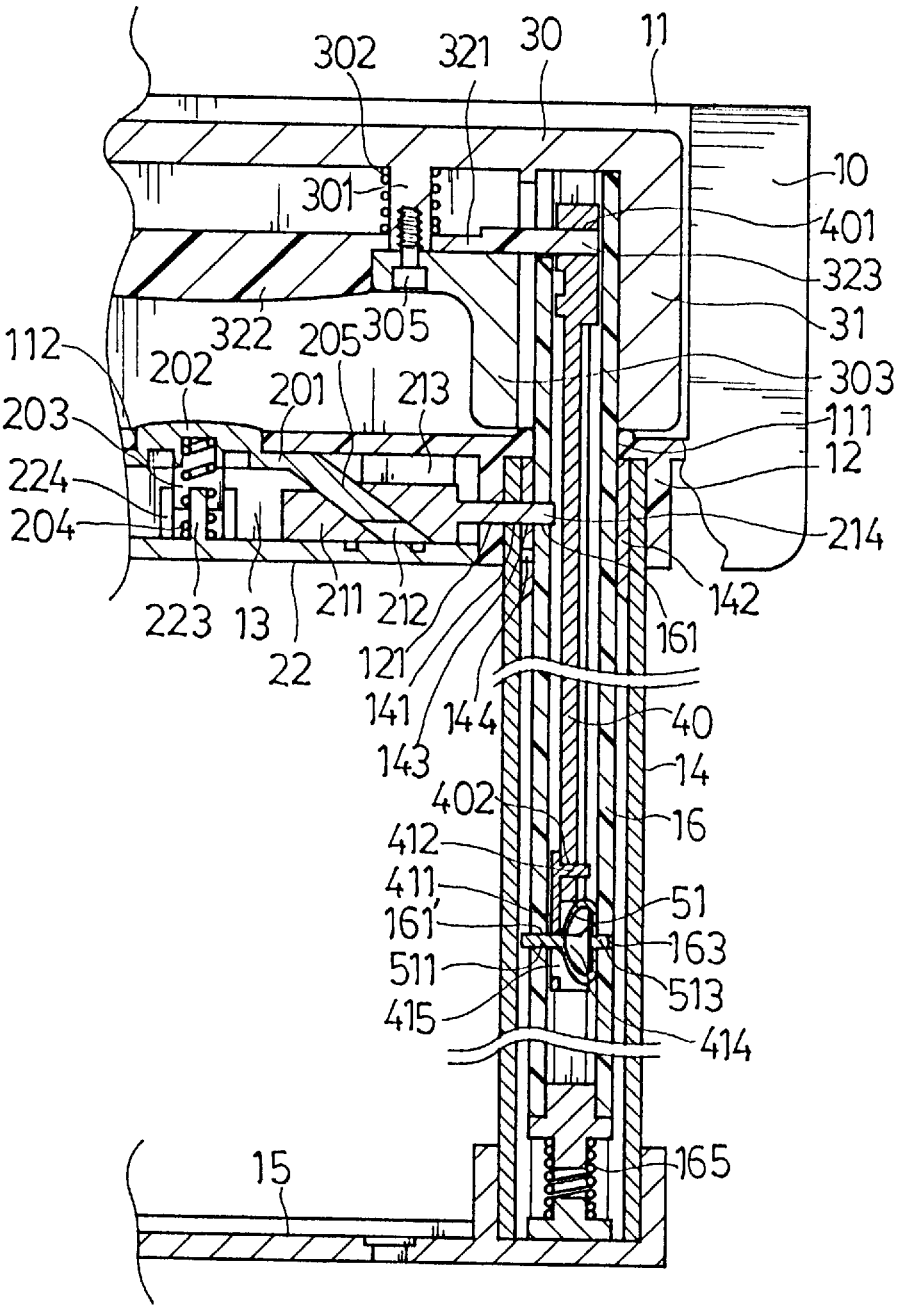
FIG. 4A is a partial view in section of the present invention, showing the inner tubes received inside the sleeves and locked.

Referring to FIGS. 2A, 3 and 4A, a casing 10 is fixedly mounted on a travel bag 100 over the connecting area between the top and back sides of the travel bag 100, comprising a top receiving chamber 11, two tubular flanges 12 bilaterally and downwardly extended from its bottom side and having a respective transverse through hole 121 at an inner side, two through holes 111 respectively communicating between the top receiving chamber 11 and the inside of the tubular flanges 12, a control box 13 raised from its bottom side and spaced between the tubular flanges 12, a button hole 112 disposed in the middle between the through holes 111 corresponding to the control box 13. A sleeve holder 15 is fixedly mounted on the back side of the travel bag 100 near the bottom. Two sleeves 14 are connected in parallel between the sleeve holder 15 and the tubular flanges 12 of the casing 10. Each sleeve 14 comprises an inside flange 142 downwardly extended from its topmost edge on the inside, a transverse outside through hole 141 made through the periphery and disposed in alignment with the transverse through hole 121 of the corresponding tubular flange 12, an upper inside through hole 143 made through the inside flange 142 and disposed in alignment with the transverse outside through hole 141 and the transverse through hole 121 of the corresponding tubular flange 12, and a lower inside hole 144 spaced below the upper inside through hole 143. A control knob 20 is mounted in the control box 13. The control knob 20 comprises a base 201 stopped below the button hole 112 and having an outer diameter greater than the diameter of the button hole 112, a knob head 202 protruding out of the button hole 112, two downward lugs 203 downwardly extended from the bottom side of the base 201 in the middle, a spring 204 fixedly fastened to the bottom side of the base 201 between the downward lugs 203, and two bevel blocks 205 respectively extended from two opposite ends of the base 201. Two stop members 21 are respectively coupled to the bevel blocks 205 of the control knob 20. Each stop member 21 comprises a base 211, a bevel hole 212 at one end of the base 211 for receiving the bevel blocks 205 of the control knob 20, two parallel upright guide blocks 213 raised from the base 211 in the middle top and adapted to move along the top wall of the control box 20, and a stop rod 214 horizontally extended from an opposite end of the base 211 and inserted into the transverse through hole 121 of one tubular flange 12 and the transverse outside through hole 141 of one sleeve 14. A bottom cover 22 is covered on the bottom open side of the control box 13, having a plurality of mounting holes 221 fixedly fastened to the control box 13 by for example screws 222, an upright rod 223 raised from its top side in the middle which holds one end, namely, the bottom end of the spring 204, and two upright lugs 224 adapted to receive the downward lugs 203 of the control knob 20.

Referring to FIGS. 2A and 4A and FIG. 3 again, two inner tubes 16 are respectively inserted through the through holes 111 of the casing 10 into the sleeves 14, having a respective bottom end mounted with a respective spring device 165. Each inner tube 16 comprises a top notch 162 at an inner side, a first locating hole 161 and a second locating hole 161' vertically spaced below the top notch 162, and a third locating hole 163 disposed at an outer side opposite to the second locating hole 161'. A hollow, bottom-open hand grip 30 is provided having two downward coupling tubes 31 at two opposite ends respectively plugged onto the top ends of the inner tubes 16, and two downward rods 301 spaced between the downward coupling tubes 31. The downward coupling tubes 31 of the hand grip 30 have a respective opening 311 corresponding to the top notches 162 of the inner tube 16. Two springs 302 are respectively mounted on the downward rods 301 of the hand grip 30. A press control device 32 is coupled to the hand grip 30 at the bottom side. The press control device 32 comprises a flat base plate 321 fitting over the bottom open side of the hand grip 30, a press block 322 raised from the bottom side of the flat base plate 321, two flanged through holes 324 disposed through the flat base plate 321 and adapted to receive the springs 302, and two coupling rods 323 respectively extended from two opposite ends of the flat base plate 321 in reversed directions and inserted through the openings 311 of the downward coupling tubes 31 of the hand grip 30 and the top notches 162 of the inner tubes 16. A hand grip cover shell 303 is covered on the bottom open side of the hand grip 30 over the press control device 32, having two mounting holes 304 near its two ends respectively fastened to the downward rods 301 of the hand grip 30, and a center opening 306 through which the press block 322 of the press control device 32 protrudes. Two screws 305 are respectively inserted through the mounting holes 304 of the hand grip cover shell 303 and the flanged through holes 324 of the press control device 32, and threaded into a respective screw hole (not shown) at the bottom end of each downward rod 301 of the hand grip 30 to fixedly secure to the hand grip cover shell 303 to the hand grip 30. Two control rods 40 are respectively mounted in the inner tubes 16. Each control rod 40 has a top coupling hole 401 fastened to one coupling rod 323 of the press control device 32, and a bottom coupling hole 402. Two elongated actuating members 41 are respectively mounted inside the inner tubes 16 and coupled to the control rods 40. Each elongated actuating member 41 comprises an elongated base 411, a coupling rod 412 perpendicularly raised from one end of the elongated base 411 and fitted into the bottom coupling hole 402 of one control rod 40, two parallel side flanges 413 perpendicularly raised along two long sides of the elongated base 411, a longitudinal sliding slot 415 through the elongated base 411 between the parallel side flanges 413, and a bevel sliding track 414 formed in the parallel side flanges 413. Two springy locating devices 50 are respectively mounted inside the inner tubes 16 and coupled to the actuating members 41. Each springy locating device 50 comprises a loop-shaped springy body 50 moved between the parallel side flanges 413 of one actuating member 41, a rear locating rod 513 raised from the loop-shaped spring body 50 at one side and fastened to the third locating hole 163 of one inner tube 16, a transverse sliding block 512 disposed at one side of the loop-shaped spring body 50 opposite to the locating rod 513 and adapted to move in the bevel sliding track 414, and a front locating rod 511 perpendicularly raised from the transverse sliding block 512 and inserted into the longitudinal sliding slot 415 of the corresponding actuating member 41.

Referring to FIG. 4A again, when the inner tubes 16 are received inside the sleeves 14, the stop rods 214 of the stop members 21 are respectively inserted through the transverse through holes 121 of the tubular flanges 12 of the casing 10 and the transverse outside through holes 141 of the sleeves 14 into the first locating holes 161 of the inner tubes 16, the spring devices 165 of the inner tubes 16 are compressed within the sleeves 14 at the bottom, and the hand grip 30 is received within the top receiving chamber 11 of the casing 10.

Figure 4B:
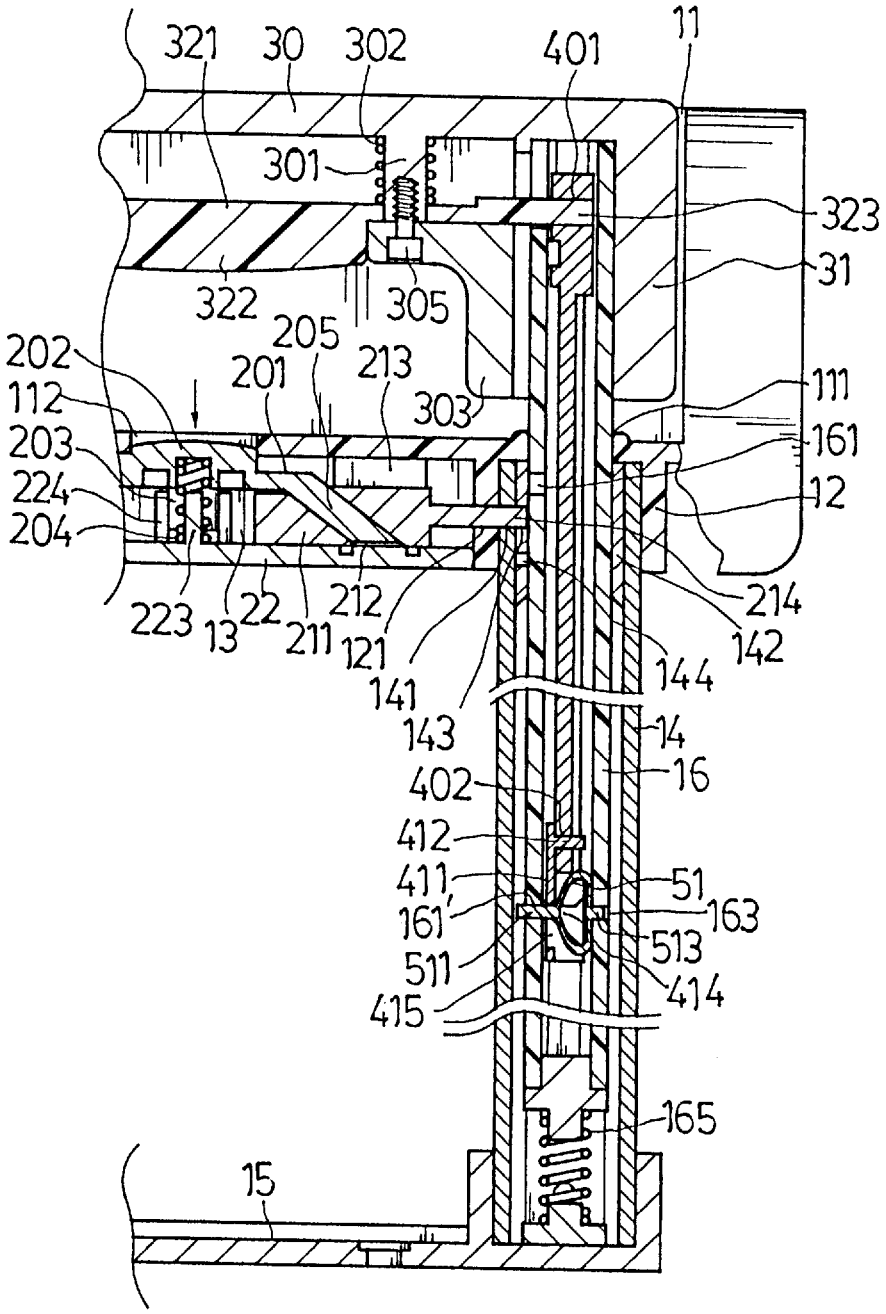
FIG. 4B is similar to FIG. 4A but showing the stop rods of the stop members disengaged from the inner tubes.
Figure 4C:
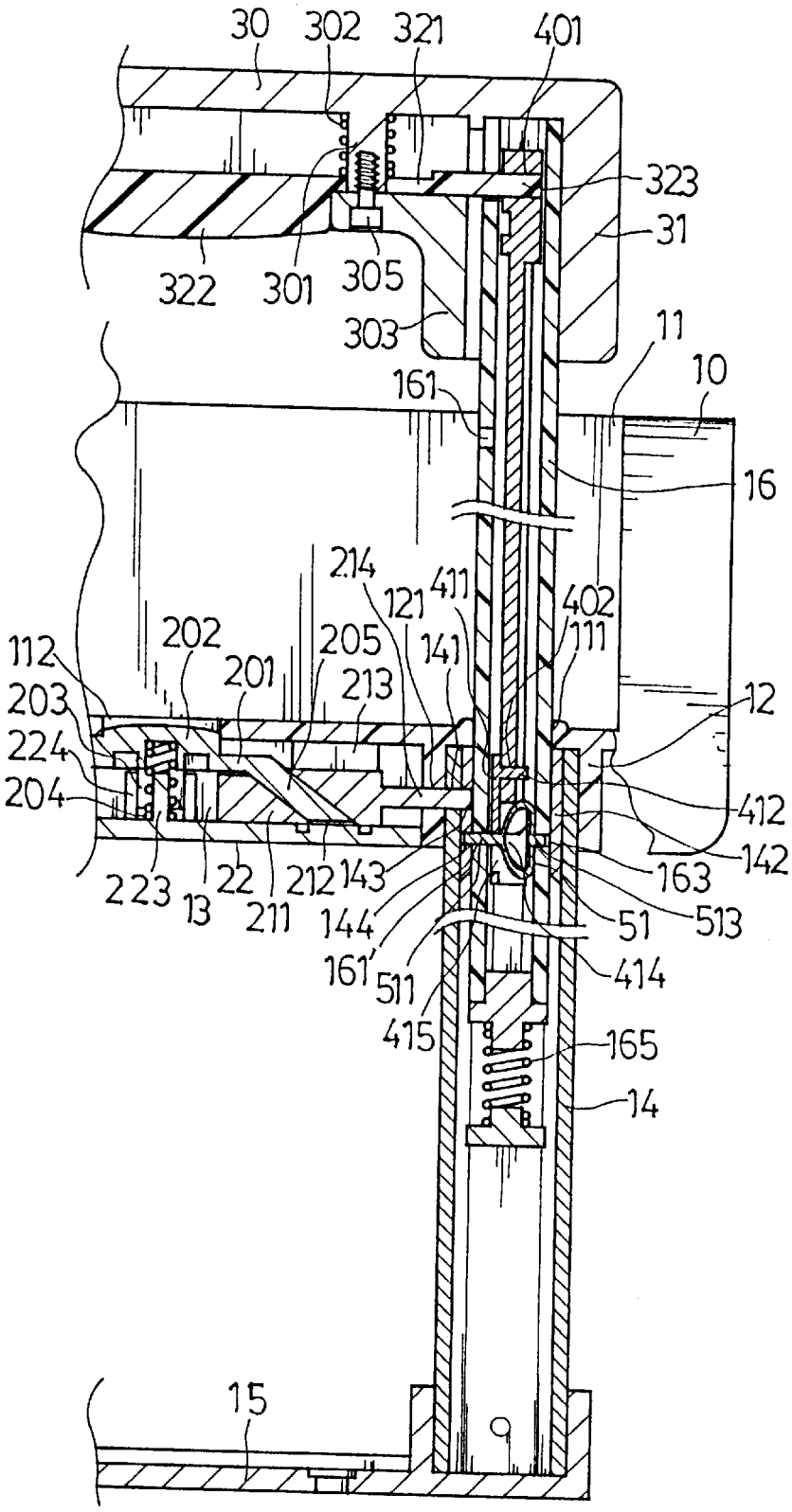
FIG. 4C is another sectional view of the present invention, showing the inner tubes extended out of the sleeves.

Referring to FIGS. 4B and 4C, when to pull the inner tubes 16 out of the sleeves 14, the knob head 202 of the control knob 20 is depressed to force the bevel blocks 205 into the bevel holes 212 of the stop members 21. When the bevel blocks 205 are forced into the bevel holes 212 of the stop members 21, the stop members 21 are forced to move inwards toward each other, thereby causing the stop rods 214 of the stop members 21 to be disengaged from the first locating holes 161 of the inner tubes 16. When the inner tubes 16 are released from the stop rods 214 of the stop members 21, the spring devices 165 of the inner tubes 16 immediately return to their former shape, thereby causing the inner tubes 16 and the hand grip 30 to be forced upwards, and therefore the user can pull the hand grip 30 upwards to move the inner tubes 16 out of the sleeves 14. When the inner tubes 16 are extended out of the sleeves 14, the front locating rods 511 of the springy locating devices 50 are forced by the spring force of the springy locating devices 50 into engagement with the transverse outside through holes 141 of the sleeves 14, and therefore the inner tubes 16 are locked in the extended position.

Figure 4D:
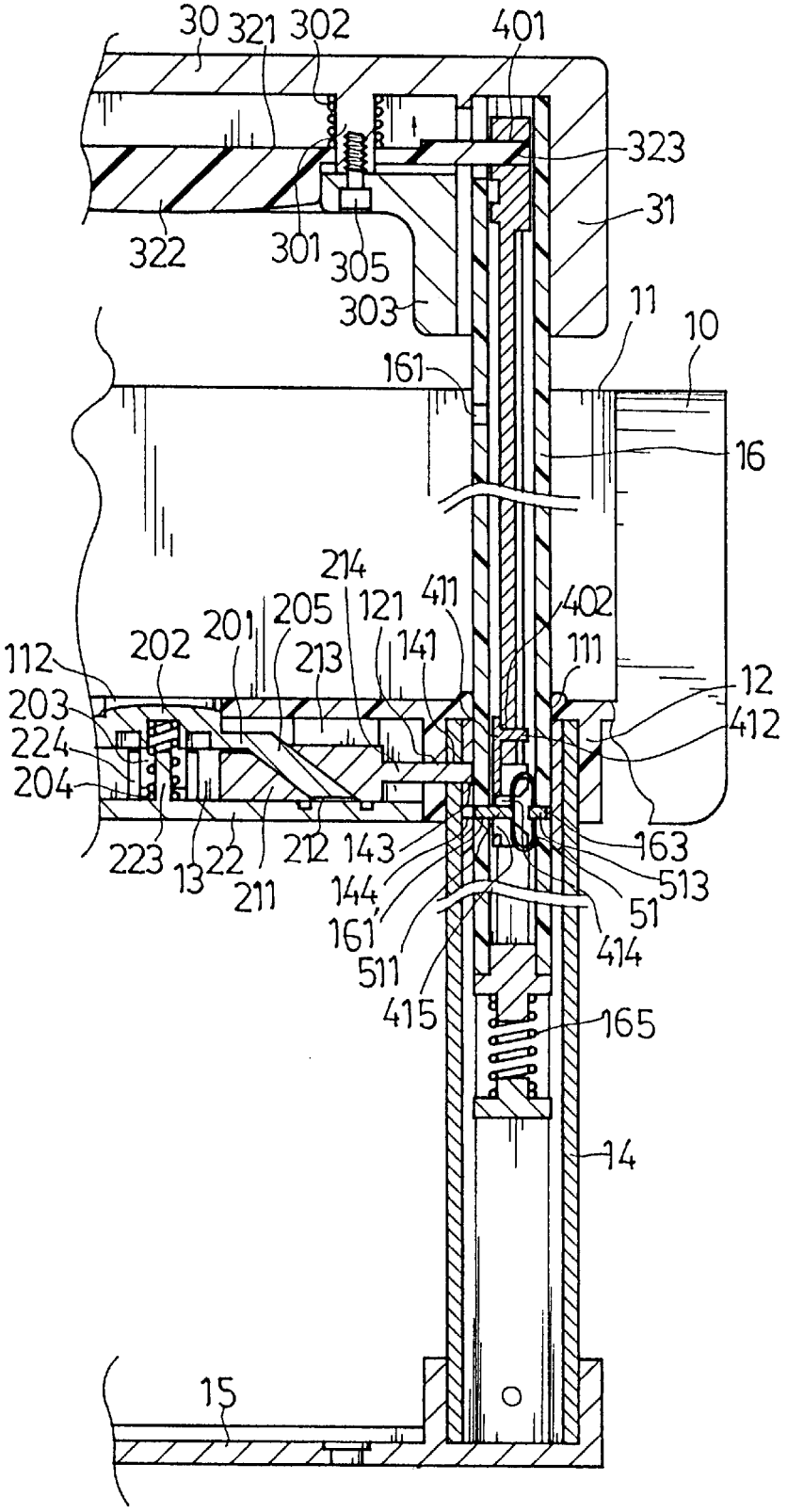
FIG. 4D is still another sectional view of the present invention, showing the inner tubes pushed back to the inside of the sleeves.

Referring to FIG. 4D, when to collapse the retractable handle, the press block 322 of the press control device 32 is pushed upwards against the springs 302 to lift the control rods 40. When the control rods 40 are lifted, the actuating members 41 are simultaneously moved upwards with the control rods 40, and the transverse sliding blocks 512 of the springy locating devices 50 are forced to move downwards along the bevel sliding tracks 414 of the actuating members 41, thereby causing the front locating rods 511 of the springy locating devices 50 to be disengaged from the lower inside through holes 144 of the inside flanges 142 of the sleeves 14, for permitting the inner tubes 16 to be pushed back to the inside of the sleeves 14. When the inner tubes 16 are pushed back to the inside of the sleeves 14, the control knob 20 is returned by its former position by the spring 204, and the stop rods 214 of the stop members 21 are forced by the bevel blocks 205 of the control knob 20 into engagement with the first locating holes 161 of the inner tubes 16, the upper inside through holes 143 of the inside flanges 142 of the sleeves 14, the transverse outside through holes 141 of the sleeves 14 and the transverse through holes 121 of the tubular flanges 12 of the casing 10.

While only one embodiment of the present invention has been shown and described, it will be understood that various modifications and changes could be made thereunto without departing from the spirit and scope of the invention disclosed.

What the invention claimed is:

1. A retractable handle mounting assembly comprising:

a casing fixedly mounted on a travel bag, said casing comprising a top receiving chamber, two tubular flanges bilaterally and downwardly extended from a bottom side thereof and having a respective transverse through hole at an inner side, two through holes respectively disposed in communication between said top receiving chamber and said tubular flanges, a bottom control box spaced between said tubular flanges and having a bottom open side covered with a bottom cover, and a button hole disposed in the middle in communication with said bottom control box;

a sleeve holder fixedly mounted on said travel bag remote from said casing;

two sleeves connected in parallel between said sleeve holder and said tubular flanges of said casing, each of said sleeves comprising an inside flange downwardly extended from its topmost edge on the inside, a transverse outside through hole made through the periphery and disposed in alignment with the transverse through hole of one tubular flange of said casing, an upper inside through hole made through said inside flange and disposed in alignment with said transverse outside through hole and the transverse through hole of the corresponding tubular flange of said casing, and a lower inside hole spaced below said upper inside through hole;

a control knob mounted in said control box, said control knob comprising a knob base stopped below said button hole of said casing, a knob head raised from said knob base and protruding out of said button hole of said casing, two bevel blocks respectively extended from two opposite ends of said knob base, a spring supported between the bottom cover of said control box and said knob base to impart an upward pressure to said knob head;

two stop members respectively coupled to said bevel blocks of said control knob and moved relative to each other by means of the control of said control knob, each of said stop members comprising a stop member base, a bevel hole at one end of the said stop member base coupled to one bevel block of said control knob, and a stop rod horizontally extended from an opposite end of said stop member base and inserted into the transverse through hole of one tubular flange of said casing and the transverse outside through hole of one sleeve and the upper inside through hole of the inside flange of the corresponding sleeve;

two inner tubes respectively inserted through the through holes of said casing into said sleeves, having a respective bottom end mounted with a respective spring device, each of said inner tubes comprising a top notch, a first locating hole and a second locating hole disposed near two opposite ends, and a third locating hole opposite to said second locating hole, said first locating hole being adapted to receive the stop rod of one stop member to let the corresponding inner tube be locked in the corresponding sleeve;

a hollow, bottom-open hand grip covered with a bottom cover shell, having two downward coupling tubes at two opposite ends respectively connected to said inner tubes outside said sleeves, said bottom cover shell having a center opening, said downward coupling tubes having a respective opening at an inner side aligned with the top notch of the corresponding inner tube;

a press control device coupled to said hand grip on the inside, said press control device comprising a flat base plate, a press block raised from a bottom side of said flat base plate and protruding out of the center opening of said bottom cover shell for pressing by hand, two spring elements supported between said flat base plate and inside wall of said hand grip, and two coupling rods respectively extended from two opposite ends of said flat base plate in reversed directions and inserted through the openings of the downward coupling tubes of said hand grip and the top notches of said inner tubes;

two control rods respectively mounted in said inner tubes and lifted by said press control device, each of said control rods having a top coupling hole fastened to one coupling rod of said press control device, and a bottom coupling hole;

two elongated actuating members respectively mounted inside said inner tubes and coupled to said control rods, each of said elongated actuating members comprising a coupling rod at one end fitted into the bottom coupling hole of one control rod, two parallel side flanges raised along two long sides thereof, a longitudinal sliding slot in the middle between said parallel side flanges, and a bevel sliding track formed in said parallel side flanges; and two resilient locating devices respectively mounted inside said inner tubes and coupled to said actuating members, each of said resilient locating devices comprising a loop-shaped resilient body moved between the parallel side flanges of one actuating member, a rear locating rod raised from said loop-shaped spring body at one side and fastened to the third locating hole of one inner tube, a transverse sliding block disposed at one side of said loop-shaped spring body opposite to said rear locating rod and adapted to move in the bevel sliding track of the corresponding actuating member, and a front locating rod perpendicularly raised from said transverse sliding block and inserted into the longitudinal sliding slot of the corresponding actuating member and the second locating hole of the corresponding inner tube and controlled by the corresponding control rod to move in and out of the lower inside through holes of the inside flanges of the corresponding sleeve.

* * * * *